US007322065B2

(12) United States Patent
Kim et al.

(10) Patent No.: US 7,322,065 B2
(45) Date of Patent: Jan. 29, 2008

(54) WASHING MACHINE AND METHOD OF CONTROLLING THE SAME

(75) Inventors: Hyung-Kyoon Kim, Suwon (KR); Sang-Yeon Pyo, Suwon (KR); Seon-Woo Park, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 667 days.

(21) Appl. No.: 10/405,910

(22) Filed: Apr. 3, 2003

(65) Prior Publication Data

US 2004/0025263 A1 Feb. 12, 2004

(30) Foreign Application Priority Data

Aug. 8, 2002 (KR) ..... 2002-46778

(51) Int. Cl.
*D06F 39/02* (2006.01)

(52) U.S. Cl. ..... 8/158; 68/12.12; 68/13 A

(58) Field of Classification Search ..... 68/12.02, 68/13 A, 12.12
See application file for complete search history.

(56) References Cited

U.S. PATENT DOCUMENTS 3,035,968 A * 5/1962 Degoli ..... 424/619
3,376,720 A * 4/1968 Hartshorn et al. ..... 68/12.18
3,547,801 A * 12/1970 Albright et al. ..... 204/272
3,597,943 A * 8/1971 Gayring ..... 68/210
3,730,682 A * 5/1973 Brubaker ..... 422/28
4,048,032 A * 9/1977 Eibl ..... 205/701
4,328,084 A * 5/1982 Shindell ..... 204/230.8
4,525,272 A * 6/1985 Henson ..... 210/149
4,755,268 A * 7/1988 Matsuo et al. ..... 205/746
5,614,067 A * 3/1997 Okazaki ..... 204/228.3
5,624,544 A * 4/1997 Deguchi et al. ..... 205/742
5,947,135 A * 9/1999 Sumida et al. ..... 134/95.3
5,954,939 A * 9/1999 Kanekuni et al. ..... 205/742
6,461,446 B1 * 10/2002 Satoh et al. ..... 134/42
6,743,351 B1 * 6/2004 Arai et al. ..... 205/701
6,766,812 B1 * 7/2004 Gadini ..... 134/56 D
7,015,184 B2 * 3/2006 Yoneda et al. ..... 510/220
2003/0108460 A1 * 6/2003 Andreev et al. ..... 422/186.07
2003/0213503 A1 * 11/2003 Price et al. ..... 134/18
2003/0213505 A1 * 11/2003 Price et al. ..... 134/25.2
2004/0172985 A1 * 9/2004 Mamiya et al. ..... 68/12.05

FOREIGN PATENT DOCUMENTS

JP 2000-312798 * 11/2000
JP 2001-353393 * 12/2001
KR 2002-37911 5/2002

* cited by examiner

*Primary Examiner*—Frankie L. Stinson
(74) *Attorney, Agent, or Firm*—Staas & Halsey LLP

(57) ABSTRACT

A disinfecting washing machine includes a disinfecting liquid dispenser, a drive unit and a control unit. The disinfecting liquid dispenser supplies a disinfecting liquid to disinfect laundry. The drive unit outputs first and second voltages to determine a concentration of the disinfecting liquid. The control unit detects the concentration of the disinfecting liquid and controlling the drive unit so that the disinfecting liquid has a concentration within a preset range.

25 Claims, 5 Drawing Sheets

V
td
td
td 316
t 318
t 314
t (A) 100%
(B) 90%
(C) 50%
326
t 328
t
(C) 50%
(B) 90%
(A) 100%

WASHING MACHINE AND METHOD OF CONTROLLING THE SAME

CROSS-REFERENCE TO RELATED APPLICATION

This application claims the benefit of Korean Application No. 2002-46778, filed Aug. 8, 2002, in the Korean Intellectual Property Office, the disclosure of which is incorporated herein by reference.

BACKGROUND OF THE INVENTION

1. Field of the Invention

The present invention relates generally to a washing machine, and more particularly, to a disinfecting washing machine equipped with a disinfecting liquid dispenser.

2. Description of the Related Art

Colloidal silver can be produced by forming silver ions ($Ag^+$) and dissolving them in water. The colloidal silver is used as an antibacterial agent or a bactericide. It is reported that the colloidal silver eliminates about 650 different kinds of bacteria. In particular, the colloidal silver is characterized as not inducing resistance, which is different from general antibiotics, and is safe because the colloidal silver has no toxic effects. Methods of manufacturing the colloidal silver are an electrolysis method, a chemical resolution method and a pulverization method.

A disinfecting washing machine is a washing machine that is equipped with a disinfecting liquid dispenser that produces and supplies a colloidal silver to disinfect laundry through antibacterial and bactericidal actions of the colloidal silver.

A conventional disinfecting washing machine is described below with reference to FIGS. 1 and 2.

FIG. 1 is a cross section of a conventional disinfecting washing machine. As shown in FIG. 1, a water tub 104 is disposed in a body casing 102 to contain washing water. A washing tub 106 is disposed in the water tub 104. A pulsator 108 is mounted in a lower portion of an interior of the washing tub 106 to be rotated in forward and reverse directions so as to form currents of the washing water. A drive unit 110 is positioned under the water tub 104 to rotate the washing tub 106 and the pulsator 108. The drive unit 110 comprises a drive motor 112 and a power transmission unit 114. The drive motor 112 is rotated by power supplied thereto, and the power transmission device 114 serves to selectively transmit power generated by the drive motor to the pulsator 108 and the washing tub 106. A belt 116 is wound around the drive motor 112 and the power transmission device 114 to mediate transmission of the power. A drain assembly 118 comprises a pipe 118*a* to drain the washing water from the washing tub 106 and a drain pipe valve 118*b*, which selectively opens and closes the drain pipe 118*a* to allow draining of the washing water from the washing tub 106.

FIG. 2 is a partially sectional view of a conventional disinfecting liquid dispenser. As depicted in FIG. 2, when power is supplied to the washing machine and a washing course is selected while laundry is contained in a disinfecting washing machine, washing water is fed into an interior of a water tub 104. The washing water fed into the water tub 104 dissolves a detergent while passing through a detergent dispenser (not shown), and is supplied to the water tub 104 along with the dissolved detergent.

If a user selects a disinfection washing course, an inlet valve 204 of a disinfecting liquid dispenser 120, connected to external source of water through an inlet pipe 212, is opened and the water is supplied to an interior of a storage container 122, whereas the washing water is fed to the water tub 104. When power is applied to two silver plates 220 and 222 of the disinfecting liquid dispenser 120, a silver disinfecting liquid is produced. The silver disinfecting liquid is supplied to the interior of the washing tub 106 and disinfects the laundry.

The water supplied though an inlet 202 of the storage container 122 is halted to stabilize a speed and a current of the water while filling a first space 210 of the storage container 122. The water contained in the first space 210 overflows a first partition 206 and flows into a second space 214. The water having passed through the first space 210 and flowing into the second space 214 fills the second space 214 to a water level corresponding to the height of a second partition 208. After the second space 214 is filled with the water, the water overflows the second partition 208 and flows into a third space 224 and then is supplied to the interior of the washing tub 106 through an outlet pipe 124 from an outlet 216 of the storage container 122. The water flows into the third space 224 while a certain amount of the water is contained in the second space 214. In a process, the silver disinfecting liquid is produced through electrolysis in the water, and the produced disinfecting liquid is supplied to the washing tub 106 through the outlet 216. The process of producing a disinfecting liquid is continuously carried out while the water is supplied to the storage container 122. A top 218 of the storage container 122 fixedly holds the sliver plates 220 and 222 in the water contained in the second space 214. The storage container 122, the top 218, the inlet 202, the outlet 216 and the bypass pipe 128 may be of a nonconductive material.

Further, in the process of producing the disinfecting liquid, if the amount of the water supplied through the inlet 202 is large, the water contained in the interior of the storage container 122 flows into a drain pipe 118*a* through a bypass pipe 128 from a bypass outlet 126 at an upper portion of the storage container 122, so the water can be maintained at an appropriate water level in the storage container 122, thereby enabling a disinfecting liquid of a certain concentration to be produced. When the process of producing a disinfecting liquid is stopped, the water supply to the storage container 122 is stopped by closing of the inlet value 204 and the power to the silver plates 220 and 222 is stopped. At that time, the water remaining in the interior of the storage container 122 flows into the outlet 216 through remaining water discharging holes 206*a* and 208*a* and is completely discharged from the storage container 122.

After the washing water including the disinfecting liquid fills the washing tub 106, washing of the laundry is performed by a rotation of the pulsator 108 and bacteria are killed by the disinfecting liquid in a process of the washing of the laundry.

The disinfecting liquid dispenser 120 carries out the electrolysis in the water by alternately applying a positive voltage and a negative voltage to the two silver plates 220 and 222, respectively, thus generating the silver ions. The amount of the silver ions, which is a concentration of the colloidal silver, is proportional to an amount of current flowing through the two silver plates 220 and 222 or an amount of voltage applied to the two silver plates 220 and 222.

The disinfecting performance obtained by the colloidal silver is determined by the concentration of the colloidal silver. If the concentration of the colloidal silver is excessively low, a disinfecting performance of the colloidal silver decreases; but if the concentration of the colloidal silver is excessively high, the colloidal silver discolors the laundry. Accordingly, the concentration of the colloidal silver has to be appropriately adjusted so as not to damage the laundry while disinfecting the laundry. To produce the appropriate concentration of the colloidal silver, the amount of voltage applied to the two silver plates 220 and 222 or the amount of current flowing through the two silver plates 220 and 222 has to be appropriately adjusted.

Since the concentration of the colloidal silver is varied according to a pressure and temperature of the water, the voltage applied to the two silver plates 220 and 222 or the current flowing through the two silver plates 220 and 222 must not be limited to a fixed value but must be varied in a certain range so as to maintain the concentration of colloidal silver in an appropriate range.

SUMMARY OF THE INVENTION

Accordingly, an aspect of the present invention is to provide a disinfecting washing machine, which is capable of controlling an amount of voltage applied to silver plates using a pulse width modulation signal, so a colloidal silver can have a concentration in an appropriate range that sufficiently disinfects laundry but does not damage the laundry.

Additional aspects and advantages of the invention will be set forth in part in the description which follows and, in part, will be obvious from the description, or may be learned by practice of the invention.

To accomplish the above and/or other aspects, a disinfecting washing machine comprises a disinfecting liquid dispenser supplying a disinfecting liquid to disinfect laundry; a drive unit outputting first and second voltages to determine a concentration of the disinfecting liquid; and a control unit detecting the concentration of the disinfecting liquid and controlling the drive unit so that the concentration of the disinfecting liquid is within a preset range.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
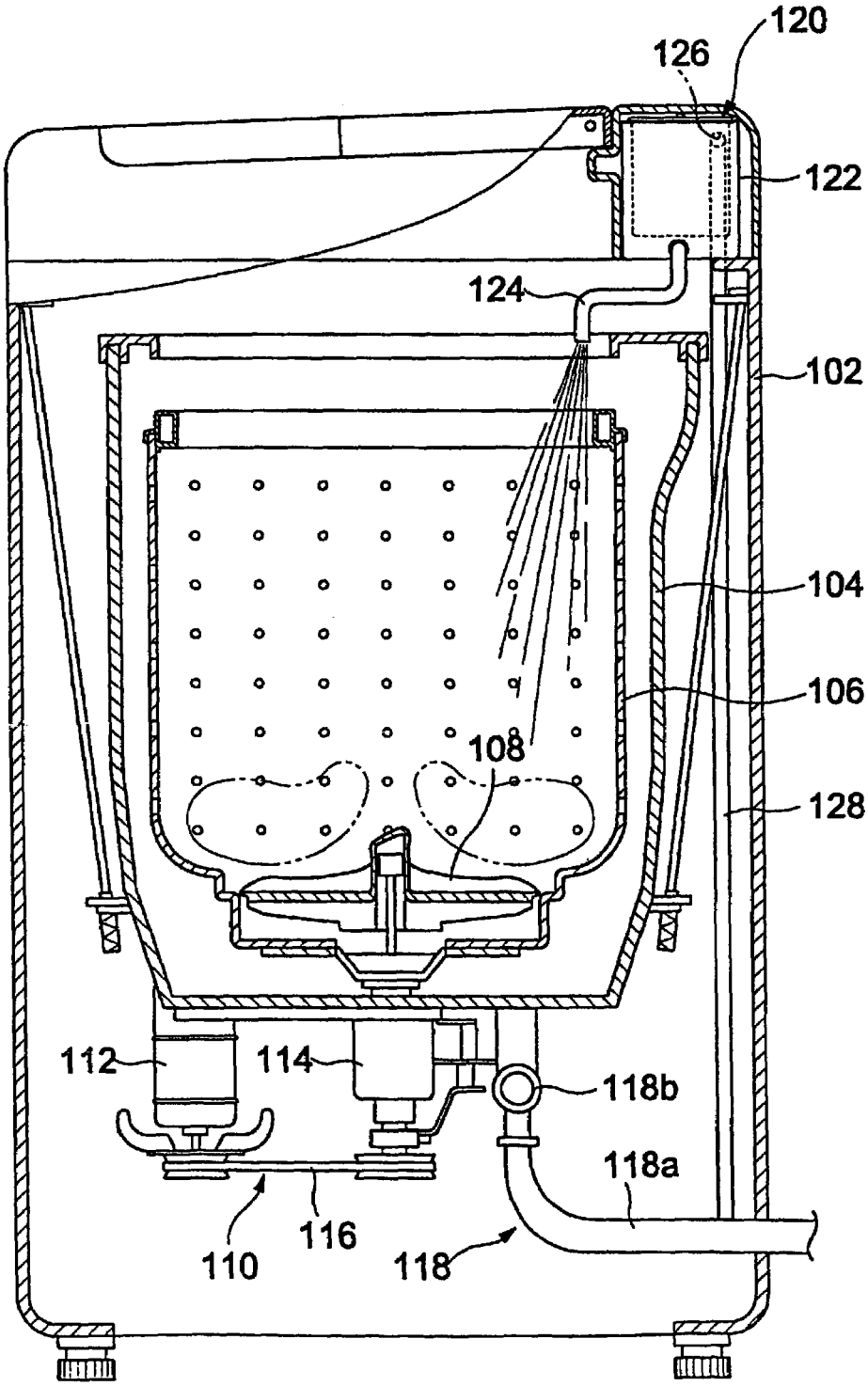
FIG. 1 (PRIOR ART)
FIG. 1 is a cross section of a conventional disinfecting washing machine.
Figure 2:
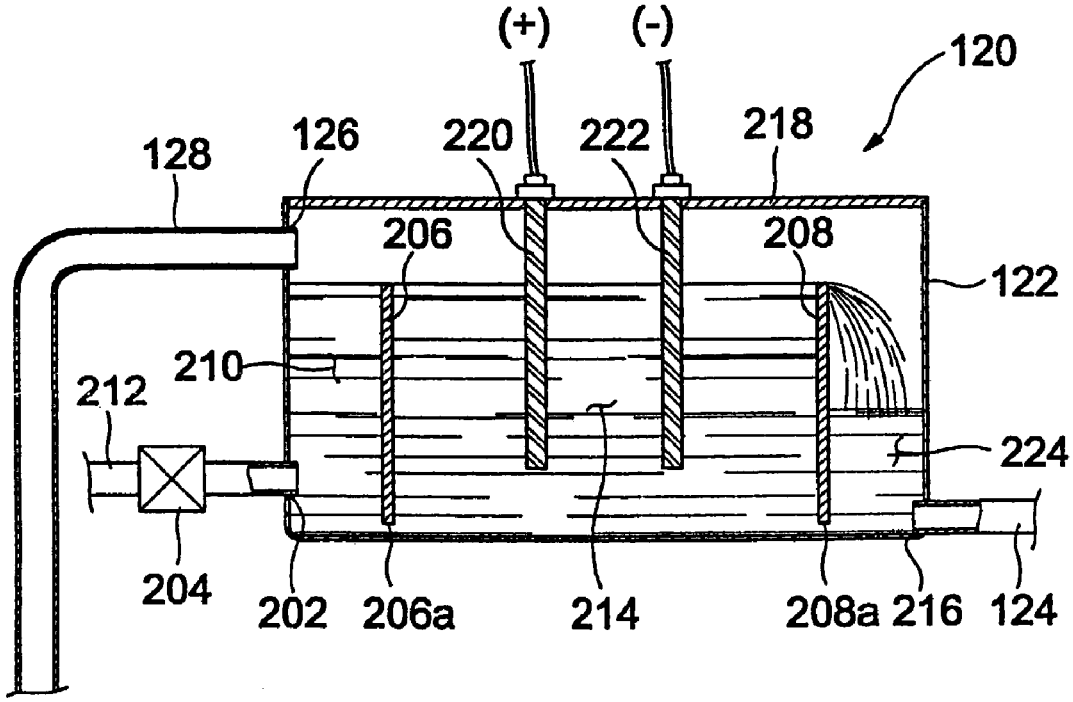
FIG. 2 (PRIOR ART)
FIG. 2 is a partially sectional view showing a disinfecting liquid dispenser of FIG. 1.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 3:
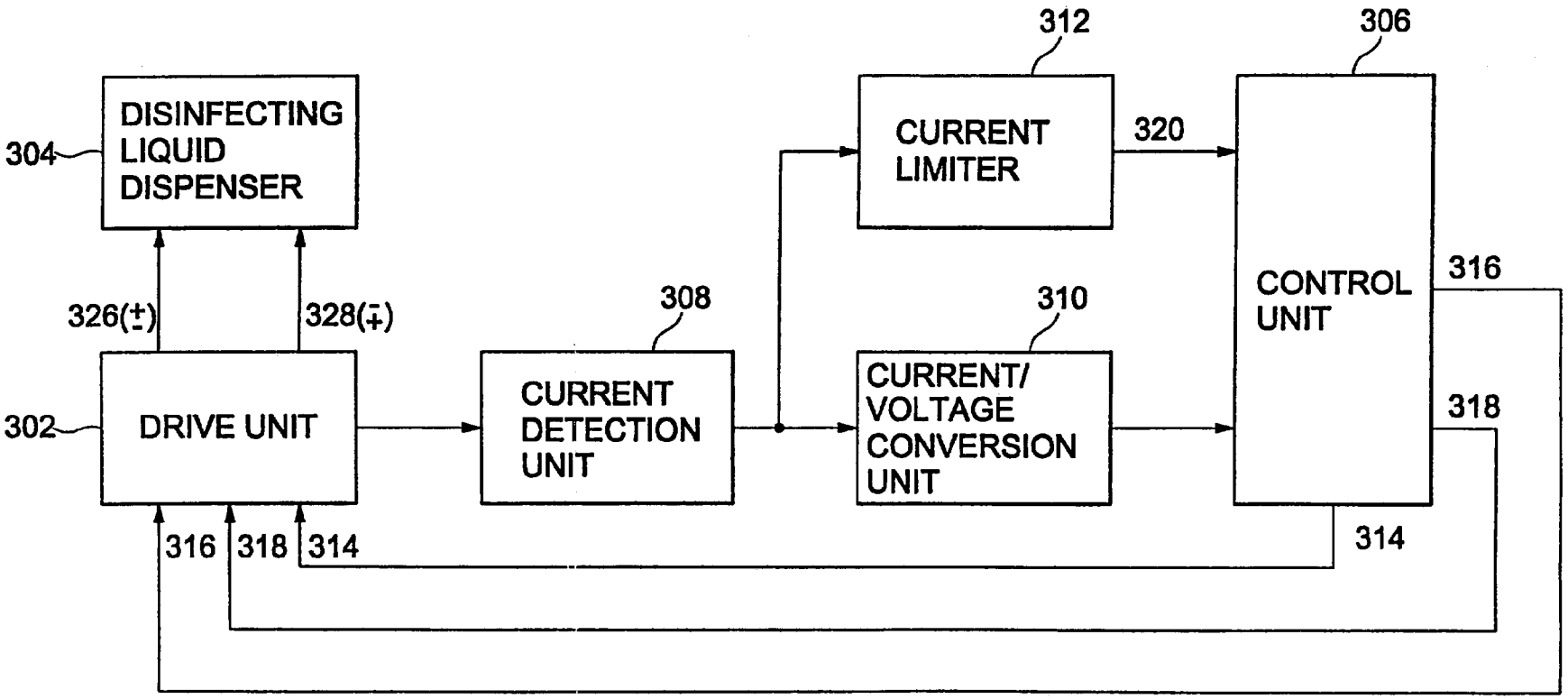
FIG. 3 is a block diagram showing a device for controlling a concentration of colloidal silver used in a washing machine of an embodiment of the present invention.

A disinfecting washing machine and method of controlling the disinfecting washing machine are described with reference to FIGS. 3, 4 and 5A-5E. FIG. 3 is a block diagram showing a device for controlling the concentration of colloidal silver used in a washing machine of an embodiment of the present invention. As shown in FIG. 3, a drive unit 302 alternately applies positive and negative voltages to a disinfecting liquid dispenser 304 to produce colloidal silver. Levels and polarities of the voltages applied to the disinfecting liquid dispenser 304 from the drive unit 302 are controlled by a duty ratio of a pulse width modulation signal 314, a first switching signal 316 and a second switching signal 318 outputted from a control unit 306 to the drive unit 302.

An amount of current supplied to the disinfecting liquid dispenser 304 is proportional to amounts of voltages applied to the disinfecting liquid dispenser 304. The amount of current, supplied to the disinfecting liquid dispenser 304, is detected by a current detection unit 308 and a current/voltage conversion unit 310. The control unit 306 determines the duty ratio of the pulse width modulation signal 314 in consideration of the amount of the current being currently supplied to the disinfecting liquid dispenser 304. If the amount of current being currently supplied to the disinfecting liquid dispenser 304 deviates from an appropriate range that can produce the colloidal silver of an appropriate concentration necessary for a disinfection of laundry, the amount of current supplied to the disinfecting liquid dispenser 304 is controlled to be in the appropriate range by increasing or decreasing a pulse width of the pulse width modulation signal 314.

If excessive amounts of voltages are supplied to the disinfecting liquid dispenser 304, a concentration of the colloidal silver is increased, thus damaging the laundry. A current limiter 312 generates an excessive current signal 320 and inputs the excessive current signal 320 to the control unit 306 when the amount of current detected by the current detection unit 308 exceeds a preset reference value. When the excessive current signal 320 is generated, the control unit 306 decreases the concentration of the colloidal silver by lowering a level of voltage applied to the disinfecting liquid dispenser 304 by decreasing the duty ratio of the pulse width modulation signal 314 to the drive unit 302, or by completely shutting off a power supply to the disinfecting liquid dispenser 304.

Figure 4:
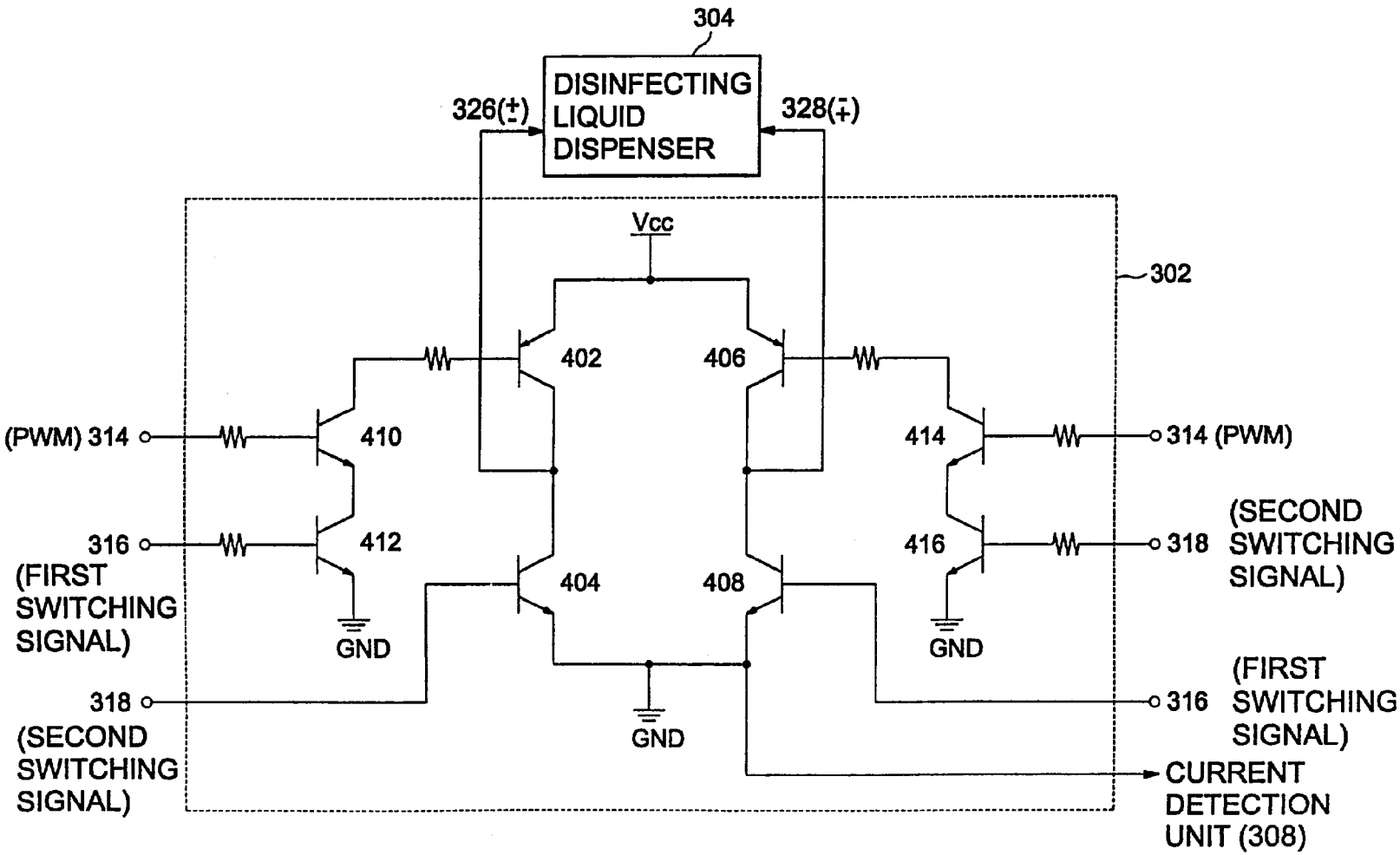
FIG. 4 is a circuit diagram of a drive unit of the colloidal silver concentration control device of the embodiment of the present invention.

A construction of the drive unit 304 controlling the concentration of the colloidal silver is described in detail below with reference to FIGS. 4 and 5A-5E. FIG. 4 is a circuit diagram showing the drive unit of the colloidal silver concentration control unit. As shown in FIG. 4, a PNP bipolar transistor 402 and an NPN bipolar transistor 404 form a first series circuit between a voltage VCC and a second voltage GND. A PNP bipolar transistor 406 and a NPN bipolar transistor 408 form a second series circuit in parallel with the first series circuit.

First and second NPN bipolar transistors 410 and 412 are connected in series to each other between a base of the PNP bipolar transistor 402 of the first series circuit and the second voltage GND. The first NPN bipolar transistor 410 is controlled by the pulse width modulation signal 314, while the second NPN bipolar transistor 412 is controlled by the first switching signal 316. Accordingly, when the pulse width modulation signal 314 and the first switching signal 316 are both at a high level, the first and second NPN bipolar transistors 410 and 412 are both turned on. When the first and second NPN bipolar transistors 410 and 412 are both turned on, the PNP bipolar transistor 402 of the first series circuit is turned on. As a result, while the second NPN bipolar transistor 412 is turned on, the duty ratio of the pulse width modulation signal 314 determines a turned-on range of the PNP bipolar transistor 402 of the first series circuit. The NPN bipolar transistor 404 of the first series circuit is controlled by the second switching signal 318. A first control voltage 326 outputted from between the PNP bipolar transistor 402 and the NPN bipolar transistor 404 of the first series circuit is applied to one of the two silver plates 220 or 222 of the disinfecting liquid dispenser 304.

Third and fourth NPN bipolar transistors 414 and 416 are connected in series to each other between a base of the PNP bipolar transistor 406 of the second series circuit and the second voltage GND. The third NPN bipolar transistor 414 is controlled by the pulse width modulation signal 314, while the fourth NPN bipolar transistor 416 is controlled by the second switching signal 318. Accordingly, when the pulse width modulation signal 314 and the second switching signal 318 are both at a high voltage level, the third and fourth NPN bipolar transistors 414 and 416 are both turned on. When the third and fourth NPN bipolar transistors 414 and 416 are both turned on, the PNP bipolar transistor 406 of the second series circuit is turned on. As a result, while the fourth NPN bipolar transistor 416 is turned on, the duty ratio of the pulse width modulation signal 314 determines a turned-on range of the PNP bipolar transistor 406 of the second series circuit. The NPN bipolar transistor 408 of the second series circuit is controlled by the first switching signal 316. A second control voltage 328 outputted from between the PNP bipolar transistor 406 and the NPN bipolar transistor 408 of the second series circuit is applied to a remaining one of the two silver plates 220 or 222 of the disinfecting liquid dispenser 304. In FIG. 4, an emitter current of the NPN bipolar transistors 404 and 416 is detected by the current detection unit 308, as shown in FIG. 3, and converted into a voltage signal in the current/voltage conversion unit 310. The control unit 306 determines an amount of current being currently supplied to the disinfecting liquid dispenser 304 based on a magnitude of the converted voltage signal.

FIGS. 5A-5E are charts showing waveforms of signals applied to the drive unit of FIG. 4.

Figures 5A, 5B, 5C, 5D, 5E:
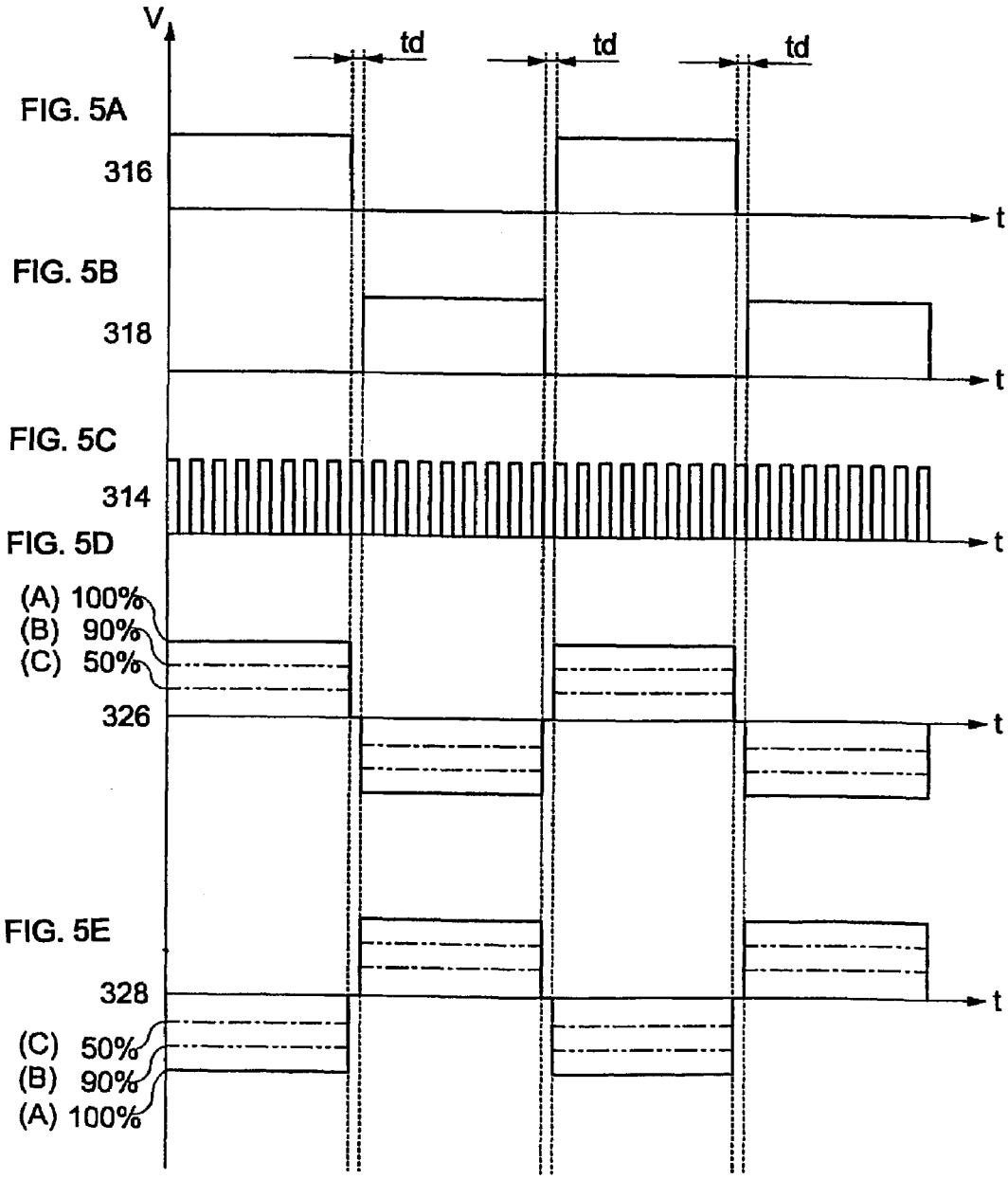
FIGS. 5A-5E are charts showing waveforms of signals applied to the drive unit of FIG. 4.

As shown in FIGS. 5A-5B, the first and second switching signals 316 and 318, which are input signals, have opposite phases, respectively. A slight dead time $t_d$ exists between transition points of the first and second switching signals 316 and 318. If the first and second switching signals 316 and 318 transition at a same time, an overlapped range is formed. In this case, the two silver plates 220 and 222 of the disinfecting liquid dispenser 304 are short-circuited. When the dead time $t_d$ is provided between the first and second signals 316 and 318, the two silver plates 220 and 222 of the disinfecting liquid dispenser 304 can be prevented from short-circuiting. As shown in FIG. 5C, the pulse width modulation signal 314, which is another input signal, is a signal whose duty ratio is variable by the control unit 306. The duty ratio of the pulse width modulation signal 314, as shown in FIG. 5C, is 100%.

As shown in FIGS. 5D-5E, the first and second control voltages 326 and 328, which are output signals, have opposite phases. A phase of the first control voltage 326 is a same phase as that of the first switching signal 316, while a phase of the second control voltage 328 is a same phase as that of the second switching signal 318. Levels of the first and second control voltages 326 and 328 are proportional to the duty ratio of the pulse width modulation signal 318. In FIG. 5D-5E, the levels "A" of the first and second control voltages 326 and 328 are for the case where the duty ratio of the pulse width modulation signal 314 is 100%, the levels "B" of the first and second control voltages 326 and 328 are for the case where the duty ratio of the pulse width modulation signal 314 is about 90%, and the levels "C" of the first and second control voltages 326 and 328 are for the case where the duty ratio of the pulse width modulation signal 314 is about 50%.

An operation of the drive unit 302, which controls the colloidal silver concentration, of the disinfecting liquid dispenser 304 is described with reference to FIGS. 4 and 5A-5E. If the first switching signal 316 of the input signals 314, 316 and 318, as shown in FIGS. 5A-5C, respectively, is at a high voltage level and the second switching signal 318 is at a low voltage level, the first switching signal 316 is a high voltage level, so the second NPN bipolar transistor 412 is turned on. In this state, since the first NPN bipolar transistor 410 is only turned on when the pulse width modulation signal 314 is in a high voltage level range, the PNP bipolar transistor 402 of the first series circuit has a turned-on range which is equal to the high voltage level range of the pulse width modulation signal 314. At this time, the second switching signal 318 is at the low voltage level, so the NPN bipolar transistor 404 of the first series circuit is turned off.

In contrast, the fourth NPN bipolar transistor 416 is turned off by the second switching signal 318 of the low voltage level. Accordingly, turned-on and turned-off operations of the third NPN bipolar transistor 414 in response to the pulse width modulation signal 314 do not affect operation of the PNP bipolar transistor 406 of the second series circuit. At this time, the first switching signal 316 is at the high voltage level, so the NPN bipolar transistor 408 of the second series circuit is turned on.

As described above, in a range where the first switching signal 316 is at the high voltage level and the second switching signal 318 is at the low voltage level, only the PNP bipolar transistor 402 of the first series circuit and the NPN bipolar transistor 408 of the second series circuit are turned on, so that a source voltage VCC, the PNP bipolar transistor 402 of the first series circuit, the disinfecting liquid dispenser 304, the NPN bipolar transistor 408 of the second series circuit and the second voltage GND provide a closed circuit to enable current to flow through the two silver plates 220 and 222. In this case, the first control voltage 326 has a positive polarity, while the second control voltage 328 has a negative polarity. Since a turned-on range of the PNP bipolar transistor 402 of the first series circuit is proportional to the duty ratio of the pulse width modulation signal 314, the levels of the first and second control voltages 326 and 328 are proportional to the duty ratio of the pulse width modulation signal 314.

If the first switching signal 316 is at the low voltage level and the second switching signal 318 is at the high voltage level as a result of alternating the voltage levels of the first and second switching signals 316 and 318, the second switching signal is at the high voltage level, so the fourth NPN bipolar transistor 416 is turned on. In this state, the third NPN bipolar transistor 414 is only turned on when the pulse width modulation signal 314 is in the high voltage level range, so that the PNP bipolar transistor 406 of the second series circuit has a turned-on range which is equal to the high voltage level range of the pulse width modulation signal 314. At this time, the first switching signal 316 is at the low voltage level, so that the NPN bipolar transistor 408 of the second series circuit is turned off.

In contrast, the second NPN bipolar transistor 412 is turned off by the first switching signal 316 of the low voltage level. Accordingly, turned-on and turned-off operations of the first NPN bipolar transistor 410 in response to the pulse width modulation signal 314 do not affect operation of the PNP bipolar transistor 402 of the first series circuit. At this time, the second switching signal 316 is at the high voltage level, so that the NPN bipolar transistor 404 of the first series circuit is turned on.

As described above, in a range where the second switching signal 318 is at the high voltage level and the first switching signal 316 is at the low voltage level, only the PNP bipolar transistor 406 of the second series circuit and the NPN bipolar transistor 404 of the first series circuit are turned on, so the source voltage VCC, the PNP bipolar transistor 406 of the second series circuit, the disinfecting liquid dispenser 304, the NPN bipolar transistor 404 of the first series circuit and the second voltage GND provide a closed circuit and enable current to flow through the two silver plates 220 and 222. In this case, the first control voltage 326 has the negative polarity, while the second control voltage 328 has the positive polarity. Since the turned-on range of the PNP bipolar transistor 406 of the second series circuit is proportional to the duty ratio of the pulse width modulation signal 314, the levels of the first and second control voltages 326 and 328 are proportional to the duty ratio of the pulse width modulation signal 314.

As described above, the polarities of the first and second control voltages 326 and 328 outputted from the drive unit 302 to the disinfecting liquid dispenser 304 are repeatedly alternated by the first and second switching signals 316 and 318. The amounts of the first and second control voltages 326 and 328 are controlled to be proportional to the duty ratio of the pulse width modulation signal 314. Since the first and second control voltages 316 and 318 are voltages applied to the two silver plates 220 and 222, the colloidal silver of a concentration proportional to the levels of the first and second control voltages 326 and 328 is produced. The control unit 306 determines whether the concentration of a currently produced colloidal silver is within an appropriate range by monitoring an amount of current flowing through the two silver plates 220 and 222. If the concentration of the colloidal silver deviates from the appropriate range, the control unit 306 adjusts the amounts of the first and second control voltages 326 and 328 applied to the disinfecting liquid dispenser 304 by varying the duty ratio of the pulse width modulation signal 314. Since the polarities of the first and second control voltages 326 and 328 are repeatedly alternated, an oxidation and a reduction of silver ions are uniformly carried out on the two silver plates 220 and 222, thus preventing only one of the two silver plates 220 and 222 from being consumed.

As described above, a disinfecting washing machine is provided, which is capable of maintaining a concentration of a colloidal silver within an appropriate range, which does not damage laundry while sufficiently disinfecting the laundry, by controlling amounts of voltages applied to silver plates based on a preset concentration of the colloidal silver using a duty ratio of a pulse width modulation signal. Further, the disinfecting washing machine prevents only one of the two silver plates from being consumed by repeatedly alternating polarities of first and second control voltages 326 and 328.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A washing machine, comprising:

a disinfecting liquid dispenser supplying a disinfecting liquid to disinfect laundry;

a drive unit outputting first and second voltages to determine a concentration of the disinfecting liquid; and a control unit detecting the concentration of the disinfecting liquid and controlling the drive unit so that the disinfecting liquid has a concentration within a preset range, wherein the drive unit receives first and second switching signals having opposite phases from the control unit, the drive unit comprising:

a first switching unit turned on in response to the pulse width modulation signal and outputting the first control voltage proportional to a duty ratio of the pulse width modulation signal when the first switching signal is at a preset voltage level, and a second switching unit turned on in response to the pulse width modulation signal and outputting the second control voltage proportional to the duty ratio of the pulse width modulation signal when the second switching signal is at the preset voltage level.

2. The washing machine according to claim 1, wherein the control unit controls the drive unit using a pulse width modulation signal so that the drive unit outputs the first and second control voltages proportional to a duty ratio of the pulse width modulation signal.

3. The washing machine according to claim 1, wherein the control unit controls the drive unit to repeat alternating phases of the first and second control voltages.

4. The washing machine according to claim 1, wherein the disinfecting liquid is a colloidal silver produced by applying the first and second control voltages to two silver plates provided in the disinfecting liquid dispenser, respectively, and carrying out electrolysis in water.

5. The washing machine according to claim 4, wherein the concentration of the disinfecting liquid is proportional to levels of the first and second voltages.

6. The washing machine according to claim 1, further comprising:

a current detection unit detecting an amount of current supplied from the drive unit to the disinfecting liquid dispenser, wherein the control unit determines the concentration of the disinfecting liquid through the amount of the current detected by the current detection unit.

7. The washing machine according to claim 1, further comprising:

a current limiter outputting an excessive current signal to the control unit when an amount of current supplied from the drive unit to the disinfecting liquid dispenser is greater than a preset reference value, wherein the control unit controls the drive unit to decrease the concentration of the disinfecting liquid when the excessive current signal is received from the current limiter.

8. A washing machine with a disinfecting liquid dispenser supplying a disinfecting liquid to disinfect laundry, and a drive unit generating the disinfecting liquid, comprising:

a control unit detecting a concentration of the disinfecting liquid and controlling the drive unit so that the disinfecting liquid has a concentration of ions within a preset range, wherein the control unit controls the drive unit using a pulse width modulation signal, a first switching signal, and a second switching signal having an opposite phase from the first switching signal, so that the drive unit outputs a first control signal proportional to the pulse width modulation signal when the first switching signal is at a preset voltage level and a second control signal proportional to the pulse width modulation signal when the second switching signal is at the preset voltage level.

9. The washing machine according to claim 8, wherein a pulse width of the pulse width modulation signal is changed to change a concentration of the disinfecting liquid.

10. The washing machine according to claim 8, wherein the disinfecting liquid is a colloidal silver comprising silver ions in water.

11. The washing machine according to claim 8, wherein the disinfecting liquid is a colloidal silver produced by applying voltages to a plurality of silver plates in water to electrolyze the plurality of silver plates in the water.

12. The washing machine according to claim 8, wherein the concentration of the disinfecting liquid is proportional to levels of the first and second control voltages.

13. The washing machine according to claim 8, further comprising:

a current detection unit detecting an amount of current supplied from the drive unit to the disinfecting liquid dispenser, wherein the control unit determines the concentration of the disinfecting liquid through the amount of the current detected by the current detection unit.

14. The washing machine according to claim 8, further comprising:

a current limiter outputting a signal to the control unit when an amount of current from the drive unit is greater than a preset value, wherein the control unit controls the drive unit according to the outputted signal from the current limiter.

15. A disinfecting unit for a washing machine, comprising:

a disinfecting liquid dispenser supplying a disinfecting liquid to laundry;

a drive outputting voltages to determine a concentration of the disinfecting liquid; and a controller controlling the drive unit so that the disinfecting liquid has a concentration within a preset range;

the disinfecting unit, further comprising:

water contained in the disinfecting liquid dispenser;

first and second silver plates provided in the water contained in the disinfecting liquid dispenser; and a drive circuit applying first and second voltages to the first and second silver plates, respectively, to carry out electrolysis, wherein the drive circuit comprises:

a first switching unit turned on in response to a pulse width modulation signal and outputting a first control signal proportional to a duty ratio of the pulse width modulation signal when a first switching signal is at a preset voltage level, a second switching unit turned on in response to the pulse width modulation signal and outputting a second control signal proportional to the duty ratio of the pulse width modulation signal when the second switching signal is at the preset voltage level, and the first and second switching units, respectively, receive the first and second switching signals having opposite phases from the controller.

16. The disinfecting unit according to claim 15, further comprising:

a current detector detecting an amount of current supplied from the drive unit to the disinfecting liquid dispenser, wherein the controller determines the concentration of the disinfecting liquid through the amount of the current detected by the current detector.

17. The disinfecting unit according to claim 15, further comprising:

a current limiter to limit current supplied from the drive unit to decrease the concentration of the disinfecting liquid when an amount of the current supplied from the drive unit to the disinfecting liquid dispenser is greater than a preset reference value.

18. A method of disinfecting laundry for a washing machine, comprising:

generating a disinfecting liquid by electrolysis;

supplying the generated disinfecting liquid;

detecting a concentration of ions in the disinfecting liquid; and controlling the concentration of the ions within a preset range, wherein the controlling comprises:

outputting first and second control voltages in response to a pulse width modulation signal to change the concentration of the ions in the disinfecting liquid, the first and second control voltages being proportional to a duty ratio of the pulse width modulation signal, changing a pulse width of the pulse width modulation signal to change the concentration of the ions in the disinfecting liquid, repeatedly alternating phases of the first and second control voltages.

19. The method according to claim 18, wherein the generating comprises:

forming the ions in water as the disinfecting liquid.

20. The method according to claim 18, wherein the generating comprises forming silver ions as the ions in water as the disinfecting liquid.

21. The method according to claim 18, wherein the generating comprises:

electrolyzing silver ions in water to form the disinfecting liquid.

22. The method according to claim 18, wherein the controlling comprises:

applying voltages to a plurality of silver plates; and electrolyzing the plurality of silver plates in water to produce the disinfecting liquid as a colloidal silver.

23. The method according to claim 18, wherein the controlling further comprises:

proportioning the concentration of the disinfecting liquid according to levels of the first and second control voltages.

24. The method according to claim 18, further comprising:

supplying current to the disinfecting liquid dispenser; and detecting an amount of the current supplied to the disinfecting liquid dispenser, wherein the controlling comprises:

determining the concentration of the disinfecting liquid according to the amount of the current detected in the detecting.

25. The method according to claim 18, further comprising:

outputting a signal when an amount of current from a drive unit is greater than a preset value, wherein the controlling comprises:

controlling the drive unit according to the outputted signal.

* * * * *

UNITED STATES PATENT AND TRADEMARK OFFICE

CERTIFICATE OF CORRECTION

PATENT NO. : 7,322,065 B2
APPLICATION NO. : 10/405910
DATED : January 29, 2008
INVENTOR(S) : Hyung-Kyoon Kim et al.

It is certified that error appears in the above-identified patent and that said Letters Patent is hereby corrected as shown below:

Column 8, Line 5, after “second” insert --control--.

Column 8, Line 39, after “second” insert --control--.

Column 9, Line 38, after “drive” insert --unit--.

Signed and Sealed this

First Day of July, 2008

JON W. DUDAS
*Director of the United States Patent and Trademark Office*